US005931488A

United States Patent [19]

Graziano et al.

[11] Patent Number: 5,931,488

[45] **Date of Patent: *Aug. 3, 1999**

[54] WHEELED FOLDING TABLE

[75] Inventors: Salvatore S. Graziano, Western Springs; Mark Stenftenagel, Elmhurst; James W. Brown, Willowbrook, all of Ill.

[73] Assignee: Bretford Manufacturing, Inc., Franklin Park, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/851,684

[22] Filed: May 6, 1997

[51] Int. Cl.[6] ..... B62B 1/02

[52] U.S. Cl. ..... 280/639; 280/38; 280/47.131; 280/47.33; 108/127

[58] Field of Search ..... 280/38, 39, 47.33, 280/641, 43.1, 47.34, 79.11, 79.3; 188/19, 20; 108/65, 121, 123, 127, 128, 132; 312/198, 209

[56] References Cited

U.S. PATENT DOCUMENTS

| | | | |
|---|---|---|---|
| 2,974,917 | 3/1961 | Kapper | 288/47.33 |
| 3,363,725 | 1/1968 | Lorrance | 188/2 |
| 3,525,492 | 8/1970 | Friedman et al. | 248/188.6 |
| 3,669,031 | 6/1972 | Cole | 108/82 |
| 4,573,415 | 3/1986 | Ramey | 108/129 |
| 4,611,823 | 9/1986 | Haas | 280/641 |
| 4,669,790 | 6/1987 | Briggs | 312/208 |
| 4,942,829 | 7/1990 | Harris | 108/65 |
| 5,085,447 | 2/1992 | Audibert | 280/47.33 |
| 5,109,778 | 5/1992 | Berkowitz et al. | 108/127 |
| 5,154,441 | 10/1992 | White et al. | 280/645 |
| 5,383,536 | 1/1995 | Butter et al. | 88/19 |

*Primary Examiner*—Richard M. Camby
*Attorney, Agent, or Firm*—Wood, Phillips, VanSanten, Clark & Mortimer

[57] ABSTRACT

A wheeled folding gateleg table having a frame member, table top and a pair of gatelegs. Each gateleg includes a foot and at least one wheel on one foot for rolling movement of the upright table.

13 Claims, 3 Drawing Sheets

WHEELED FOLDING TABLE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

This invention relates to a folding gateleg table and, more particularly, to a wheeled folding gateleg table that is easily moved about when the table is in an upright or operative position.

Folding tables are often set up for temporary use at meetings, seminars or the like. Such tables may be subjected to rough handling and, as a result, are typically of a sturdy and thus heavy construction.

These heavy folding tables, when in an upright or operative position, are awkward to move. It is almost impossible for one person, alone, to move an upright folding table without dragging or pushing it across the floor. Maneuvering a heavy folding table in such a way can damage the table, the floor, or both. Even with the assistance of another person, it is inconvenient, and often difficult, to move an upright folding table.

A folding gateleg table with wheels for movement when the table is folded is shown in Graziano et al. application, Ser. No. 08/468,729, filed Jun. 6, 1995, assigned to the assignee of this application. The wheels are locked with the table in upright position, preventing rolling movement. It is however, often desirable to move such a table in the upright position, as in arranging tables for a conference or the like.

BRIEF SUMMARY OF THE INVENTION

A principal feature of the present invention is a wheeled folding table including a frame member, two gatelegs connected to the frame member and at least one wheel attached to one gateleg for rolling movement of the upright table.

Another feature is that the wheel rotates on an axis perpendicular to the frame member when the table is in an upright position.

A further feature is that the other gateleg is not equipped with wheels and will resist movement of the upright table.

Still another feature is that four wheels grouped in two pairs are attached to the one gateleg with each pair mounted towards an end of the one gateleg. All four wheels of the one gateleg rotate at an axis perpendicular to the frame member when the table is in an upright position.

And a further feature is the provision of a brake for locking the wheels.

Further features and advantages will appear from the following description and from the drawings.

DETAILED DESCRIPTION OF THE INVENTION

Figure 1:
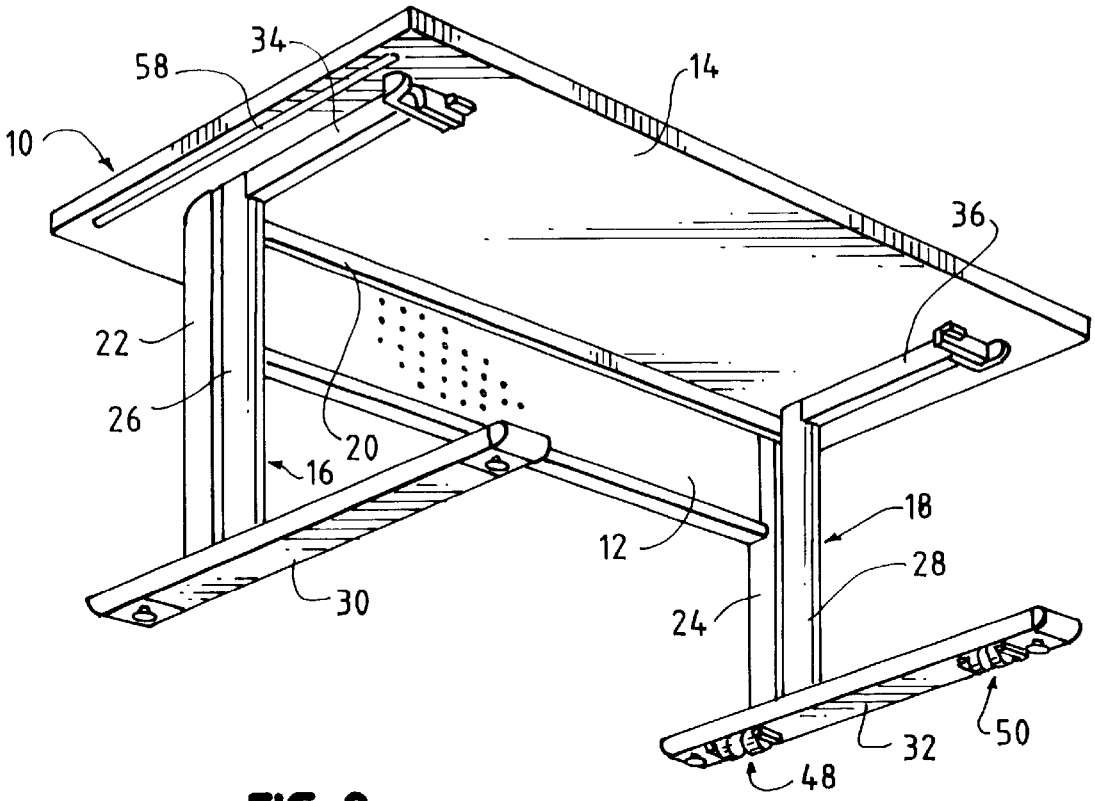
FIG. 1 is a bottom perspective view of the table in its upright or unfolded position.
Figure 2:
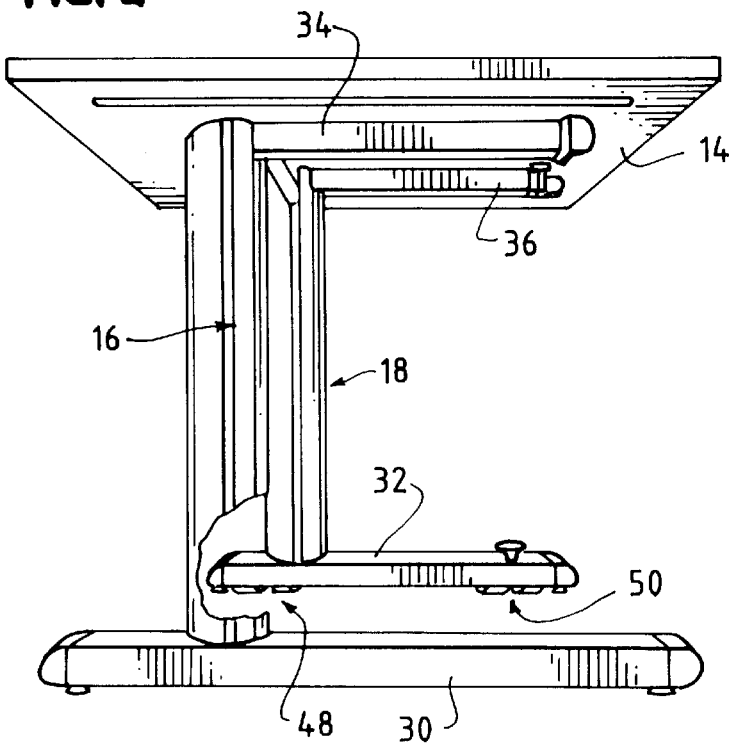
FIG. 2 is an end perspective view of the table in its upright or unfolded position, from the left of FIG. 1, with a portion of a leg broken away.

A wheeled folding gateleg table, generally designated 10, is shown in an upright or operative position, FIGS. 1 and 2. The table 10 includes a longitudinally-extending frame member 12, a table top 14, and two gatelegs 16,18.

Figure 3:
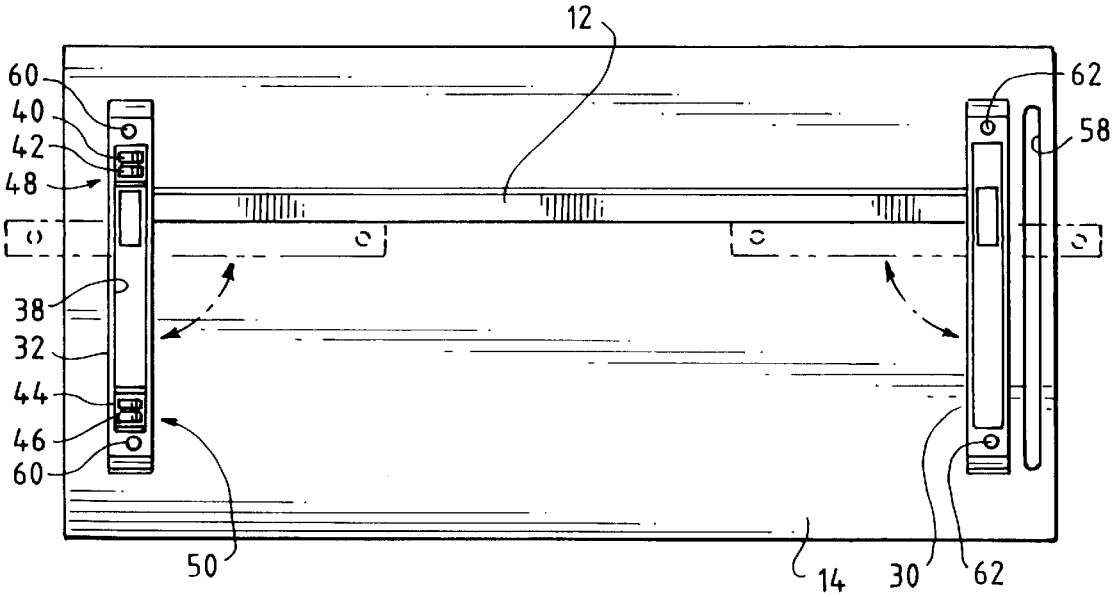
FIG. 3 is a bottom plan view of the table, illustrating the movement of the gatelegs between upright and folded positions.

The frame member 12 is a perforated rectangular steel sheet, which serves as a modesty panel. The table top 14 is hinged to the upper edge 20 of the frame member 12. The table top 14 swings away from the frame member 12 when going from a folded to an upright and operative position. The gatelegs 16,18 are hinged at each end of the frame member 12 and swing outwardly of frame member 12 when going from a folded to an upright and operative position, as illustrated by the dashed line showing and arrows, FIG. 3.

The gatelegs 16,18 each have a fixed vertical leg section 22,24, secured to the ends of the frame and a pivoted vertical leg section 26,28. The pivoted vertical leg sections 26,28 are hinged to the fixed vertical leg sections 22,24, respectively. Details of the hinge are shown in the aforementioned application.

The pivoted leg sections 26,28 of gatelegs 16,18 each have a foot 30,32 and a table top support arm 34,36. The feet 30,32 rest on the floor to carry the table 10. The support arms 34,36 extend from the upper ends of the pivoted vertical leg sections 26,28. The table top 14 rests on the support arms 34,36 in the upright position of the table.

When the table 10 is in an upright and operative position, the feet 30,32 and arms 34,36 extend at right angles to the frame member 12. In folded position, the feet 30,32 extend towards each other and parallel to frame member 12, as shown in dashed lines, FIG. 3.

The foot 32 of leg 18 is a downwardly-open channel 38 with four wheels 40, 42, 44 and 46 mounted therein. The wheels are grouped into two pairs 40,50, one adjacent each end of foot 32.

The axes of the wheels 40, 42, 44 and 46 are parallel with the length of foot 32.

Figure 4:
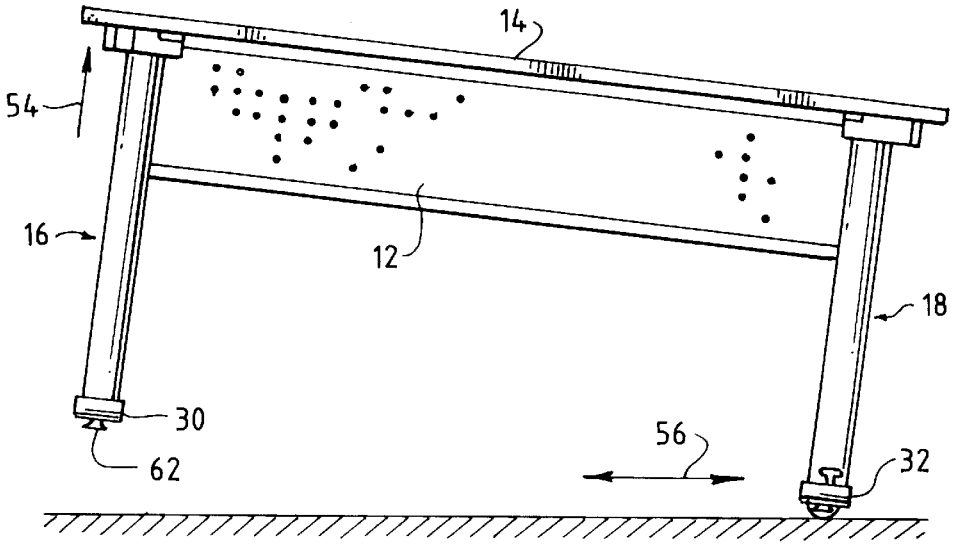
FIG. 4 is a rear elevation of the upright table being moved.

With the table upright, foot 32 and the axes of the wheels are at right angles to the table frame 12 and the longitudinal extent of the table. The end of the table opposite foot 32 is lifted, as indicated by arrow 54, FIG. 4, and the table may be moved about by rolling on the wheels, as indicated by arrow 56. The under surface of table top 14 is provided with finger groove 58 to facilitate lifting and movement by pushing or pulling. A heavy table is easily moved by one person.

With the table located in the intended position, a brake, described below, associated with wheel pair 50 is set, restraining further movement. Threaded glides 60 are preferably provided in the under surface of foot 32 and may be adjusted to lift the wheels off the floor. Threaded glides 62 on foot 30 are adjusted to level the table.

Figure 5:
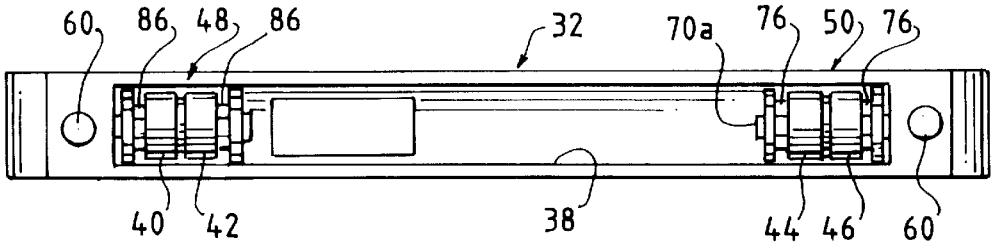
FIG. 5 is an enlarged bottom view of a gateleg foot equipped with wheels.
Figure 6:
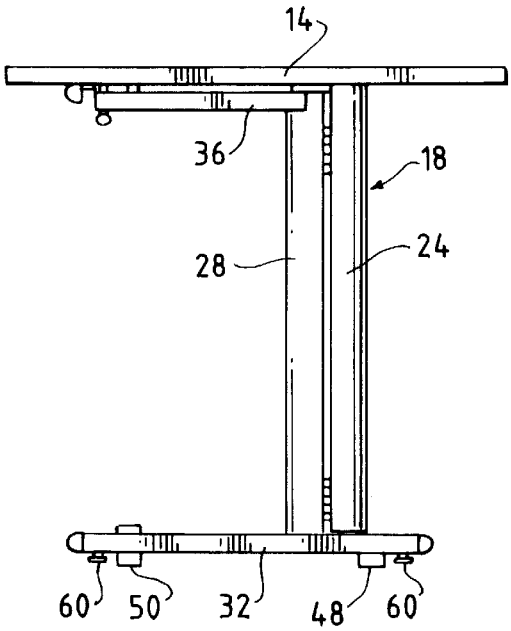
FIG. 6 is an end view of the upright table looking from the right of FIG. 1.
Figure 7:
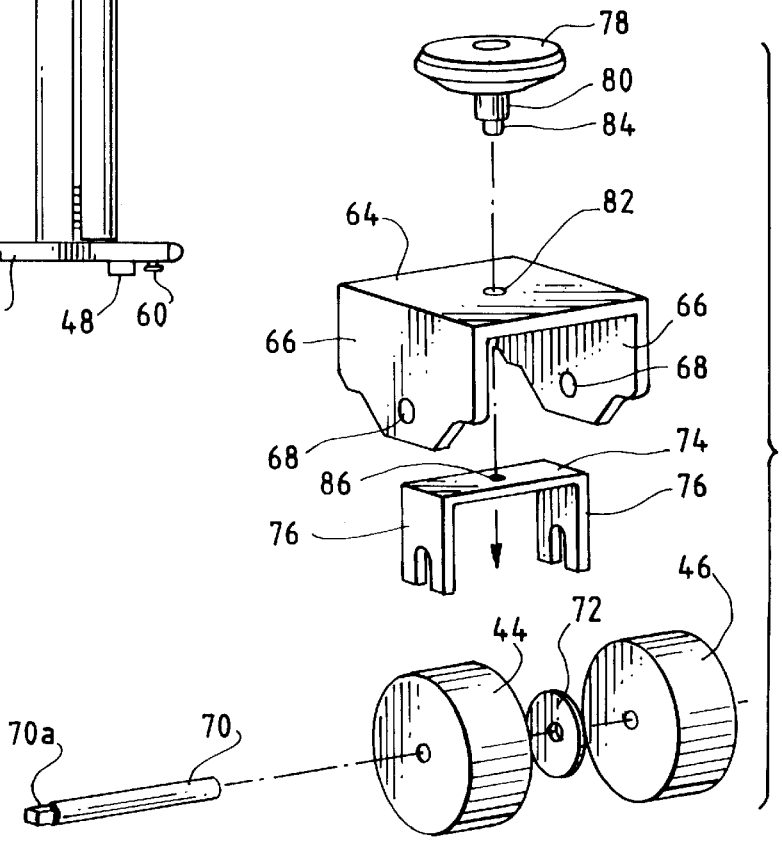
FIG. 7 is an exploded view of the wheels and brake with the foot omitted for clarity.

The wheel mounting and brake are illustrated in FIGS. 5 and 7. Wheel mounting brackets 64 are secured in the open bottom channel 38 of foot 32. Bracket 64 has depending legs 66 with aligned holes 68. Wheels 44,46 of wheel pair 50 are mounted on pin 70 that extends through the holes 68. One end of the pin 70 has a swaged, flat head 72 driven into the bracket leg 66 to anchor the pin. A washer 72 on the pin separates the wheels.

The brake is a U-shaped friction plate 74 with bifurcated legs 76 which extend on either side of wheels 44,46 and embrace pin 70. Brake actuator 78 has a shank 80 which extends through the top of table foot 32 and is threaded in a hole 82 in the base of bracket 64. The end 84 of shank 80 is rotatably secured in a hole 86 of friction plate 74. Rotation of actuator 78 in one direction advances friction plate 74 with respect to bracket 64 and foot 32 into frictional and locking engagement with the surfaces of wheels 44,46, setting the brake. Rotation of actuator 78 in the opposite direction retracts friction plate 74, releasing the brake for rolling movement of the table.

The bifurcated legs 76 of friction plate 74 space the wheels 44,46 from the legs 66 of bracket 64.

The wheel pair 48 is similarly mounted on a bracket at the other end of foot 32. As there is no brake for this wheel pair, washers 86 space the wheels 40,42 from the legs of the bracket.

The swaged head 72 of pin 70 may extend through bracket legs 66. Without the spacing provided by friction plate leg 76 or washer 86, the sharp edges of the swaged head would cut the adjacent wheel as it turns.

What is claimed is:

1. In a wheeled folding gateleg table, a frame member having two ends, a table top hinged to said frame member for movement between upright and folded positions and a pair of gatelegs one hinged at each end of said frame member, each of said gatelegs having an elongate foot and a table top support arm and being movable between a table-supporting, upright position generally at right angles to said frame member and a folded position parallel to said frame member, the improvement comprising:

first and second wheels, at opposite ends of one foot for rolling movement of the upright table, said wheels rotating on a fixed axis perpendicular to said frame member when said table is in an upright position.

2. The table of claim 1 with a pair of wheels at each end of said foot.

3. The table of claim 2, wherein each pair of wheels is mounted on a pin attached to mounting plates on the foot of said one gateleg, and a spacing washer on the pin between the wheels of each wheel pair.

4. The table of claim 1 wherein the foot is a downwardly-open channel with two U-shaped mounting brackets in the channel, the brackets having two spaced-apart legs and pins extending between the legs with one of said wheels mounted on each pin.

5. The table of claim 1, including a brake for one of said wheels.

6. The table of claim 5 in which said brake includes a friction plate adjacent the wheel and an actuator for moving the plate toward and away from said wheel.

7. The table of claim 6 in which the foot is a downwardly opening channel with a wheel mounted on a pin extending between the legs of a U-shaped bracket in the channel and the friction plate is U-shaped with bifurcated legs embracing said pin on either side of the wheel and the actuator moves the plate radially of the wheel toward and away from the wheel periphery.

8. The table of claim 7 in which the actuator is connected with the friction plate and threaded to the channel for such radial movement.

9. The table of claim 4 wherein the spaced-apart legs of each bracket have aligned holes with said pin extending through the holes, the pin having a swaged head, flat in the plane of the pin, press-fit in one of the holes, the head extending partially through the leg of the bracket, and means between the wheel and bracket spacing the wheel from the head of the pin.

10. The table of claim 9 wherein the means spacing the wheel from the head of the pin is a washer on said pin.

11. The table of claim 9 wherein a brake for one of said wheels comprises a U-shaped friction plate movable radially of the wheel and having a bifurcated leg embracing the pin and spacing the wheel from the flat swaged head.

12. In a wheeled table having a pair of spaced apart supporting legs, one of said legs having an elongate foot, the length of the foot being at right angles to the spacing between the legs, the improvement comprising:

the foot having a downward opening channel at each end thereof; and a wheel in the channel at each end of the foot, both wheels having a fixed axis of rotation parallel with the length of the elongate foot, the other leg having no wheel and when resting on the floor resisting movement of the table.

13. The wheeled table of claim 12 with a U-shaped mounting bracket in the channel at each end of the foot, each bracket having two spaced-apart legs and a pin extending between the legs with the wheel at each end of the foot mounted on the pin.

* * * * *

UNITED STATES PATENT AND TRADEMARK OFFICE

CERTIFICATE OF CORRECTION

PATENT NO. : 5,931,488
DATED : August 3, 1999
INVENTOR(S) : Graziano et al.

It is certified that error appears in the above-indentified patent and that said Letters Patent is hereby corrected as shown below:

Please add claim 14 as follows:

14. In a wheeled folding gateleg table, a frame member having two ends, a table top hinged to said frame member for movement between upright and folded positions and a pair of gatelegs, one hinged at each end of said frame member, each of said gatelegs having a foot and a table top support arm and being movable between a table-supporting, upright position generally at right angles to said frame member and a folded position parallel to said frame member, the improvement comprising at least one wheel, on one foot for rolling movement of the upright table, the other gateleg having no wheel and when resting on a floor resisting movement of the upright table.

Signed and Sealed this

Twenty-eighth Day of March, 2000

*Attest:*

*Attesting Officer*

Q. TODD DICKINSON

*Commissioner of Patents and Trademarks*

US005931488C1

(12) EX PARTE REEXAMINATION CERTIFICATE (5322nd)

United States Patent
Graziano et al.

(10) Number: US 5,931,488 C1
(45) Certificate Issued: Apr. 4, 2006

(54) WHEELED FOLDING TABLE

(75) Inventors: Salvatore S. Graziano, Western Springs, IL (US); Mark Stenftenagel, Elmhurst, IL (US); James W. Brown, Willowbrook, IL (US)

(73) Assignee: Bretford Manufacturing, Inc., Franklin Park, IL (US)

Reexamination Request:
No. 90/006,643, May 19, 2003

Reexamination Certificate for:

| | |
|---|---|
| Patent No.: | **5,931,488** |
| Issued: | **Aug. 3, 1999** |
| Appl. No.: | **08/851,684** |
| Filed: | **May 6, 1997** |

Certificate of Correction issued Mar. 28, 2000.

(51) Int. Cl.
*B62B 1/02* (2006.01)

(52) U.S. Cl. ..... 280/639; 280/38; 280/47.131; 280/47.33; 108/127

(58) Field of Classification Search ..... None
See application file for complete search history.

(56) References Cited

U.S. PATENT DOCUMENTS

| | | | | | |
|---|---|---|---|---|---|
| 876,857 | A | * | 1/1908 | Bugbee | 108/94 |
| 2,744,710 | A | * | 5/1956 | Gerosa | 248/129 |
| 3,018,574 | A | | 1/1962 | Munson et al. | |
| 3,069,719 | A | | 12/1962 | Ridge | |
| 3,105,698 | A | * | 10/1963 | Bonarrigo et al. | 280/47.131 |
| 3,411,802 | A | * | 11/1968 | Diller | 280/79.11 |
| 5,337,657 | A | * | 8/1994 | Diffrient | 108/115 |
| 5,383,536 | A | * | 1/1995 | Butter et al. | 188/1.12 |
| 5,586,803 | A | * | 12/1996 | Overpeck | 297/158.3 |

* cited by examiner

*Primary Examiner*—Frank Vanaman

(57) ABSTRACT

A wheeled folding gateleg table having a frame member, table top and a pair of gatelegs. Each gateleg includes a foot and at least one wheel on one foot for rolling movement of the upright table.

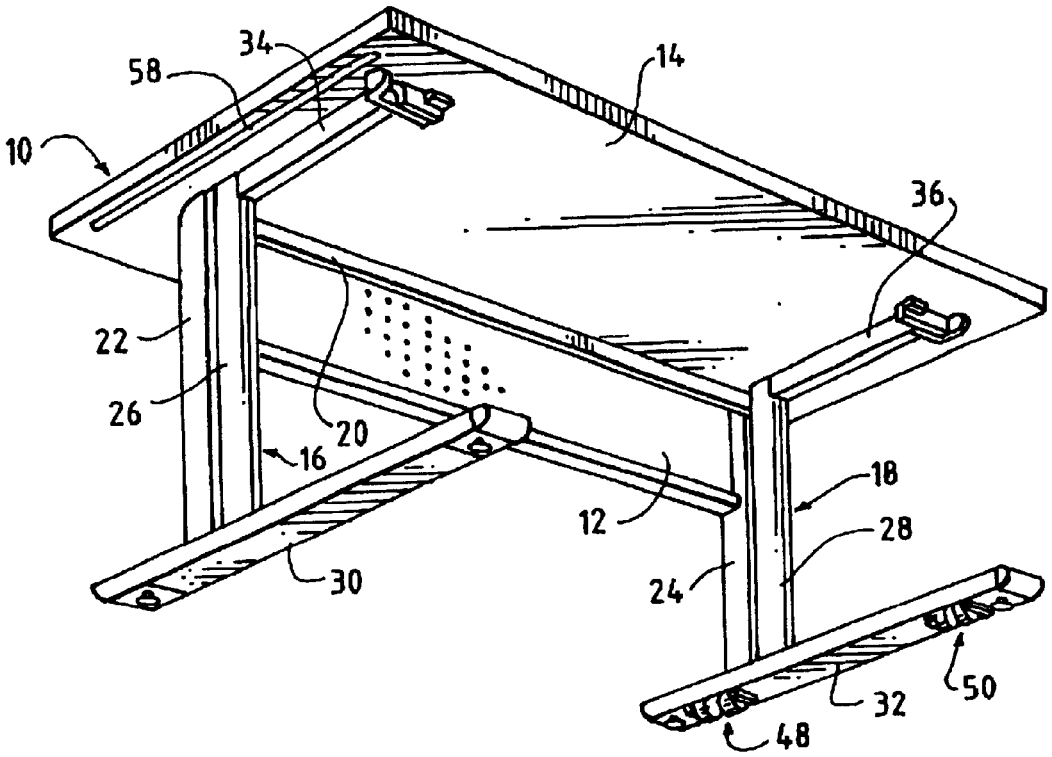

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 4 and 7–11 is confirmed.

Claims 1–3, 5, 6 and 12–14 are cancelled.

* * * * *